US006375413B1

(12) United States Patent
Stones

(10) Patent No.: US 6,375,413 B1
(45) Date of Patent: Apr. 23, 2002

(54) VACUUM PUMPS

(75) Inventor: Ian David Stones, Burgess Hill (GB)

(73) Assignee: The BOC Group plc, Windlesham (GB)

( * ) Notice: Subject to any disclaimer, the term of this patent is extended or adjusted under 35 U.S.C. 154(b) by 0 days.

(21) Appl. No.: 09/710,298

(22) Filed: Nov. 9, 2000

(30) Foreign Application Priority Data

Nov. 19, 1999 (GB) ..... 9927493

(51) Int. Cl.[7] ..... F01D 1/36; F04D 19/04
(52) U.S. Cl. ..... 415/90; 415/73
(58) Field of Search ..... 415/90, 143, 71, 415/73, 77, 83, 84; 417/423.4

(56) References Cited

U.S. PATENT DOCUMENTS 5,848,873 A * 12/1998 Schofield ..... 415/90
5,893,702 A * 4/1999 Conrad et al. ..... 415/90 X

FOREIGN PATENT DOCUMENTS

EP 0 805 275 A2 11/1997

* cited by examiner

*Primary Examiner*—John E. Ryznic

(57) ABSTRACT

A vacuum pump for pumping gas from a pump inlet to a pump outlet, comprising a rotor and a stator body in which the rotor is adapted for rotation and including at least two molecular drag stages each comprising adjacent stationary and rotating Holweck cylinders attached to the stator body and the rotor respectively and with a threaded upstanding helical flange positioned therebetween which is attached either to the stationary or to the rotating cylinder wherein the molecular drag stage closest to the pump inlet has the threaded flange on its rotating cylinder and the subsequent molecular drag stage or stages has the threaded flange on the stationary cylinder.

11 Claims, 5 Drawing Sheets

VACUUM PUMPS

FIELD OF THE INVENTION

This invention relates to vacuum pumps and, more particularly, to pumps employing molecular drag mode of operation, preferably in conjunction with a regenerative mode of operation.

BACKGROUND OF THE INVENTION

Vacuum pumps and/or compressors are known which operate in a regenerative mode and in which a rotor spins at high speed, for example ten thousand revolutions/min (10,000 rpm), within a stator body and in which the rotor has a series of blades positioned in an annular array either on a peripheral edge of the rotor or alternatively on a side of the rotor at its periphery, and the stator has an annular channel within which the blades rotate having a cross sectional area greater than that of the individual blades except for a small part of the channel known as a "stripper" which has a reduced cross section providing a close clearance for the blades.

In use of such a pump, gas to be pumped enters the annular channel via an inlet positioned adjacent one end of the stripper and the gas is urged by means of the blades on the rotating rotor along the channel until it strikes the other end of the stripper and the gas is then urged through an outlet situated on that other end of the stripper. It is known that pumps/compressors employing such a mode of operation can provide a high compression ratio at relatively low flow rates. However, these pumps are best suited to pumping in continuum flow conditions and with such pumps it can be difficult to obtain a sufficiently high ultimate vacuum and pumping speed without resort to the use of an additional vacuum pump in tandem which is suited to transitional and/or molecular flow.

In our earlier European Patent Application No. 0 805 275 A, we described a vacuum pump in which a substantially higher compression could be obtained through the use of a multi-stage pumping action associated with the rotor in particular. In our earlier European Application, there was disclosed a vacuum pump of the regenerative type comprising a rotor and a stator body in which the rotor was adapted for rotation and in which the rotor had a series of blades positioned in an annular array on a side of the rotor and the stator had an annular channel within which the blades could rotate having a cross-sectional area greater than that of the individual blades except for a small part of the channel which had a reduced cross-section providing a close clearance for the blades and wherein the rotor had at least two series of blades positioned in concentric annular arrays on a side of the rotor and the stator had a corresponding number of channels within which the blades of the arrays could rotate and means were provided to link the channels to form a continuous passageway through which gas being evacuated by the pump could pass.

It was further disclosed that the pumps of the earlier European application may be employed:

i) as individual vacuum pumps in their own right, ii) in conjunction with other vacuum pumps such as turbo molecular pumps or molecular drag pumps, iii) as a component part of larger hybrid vacuum pumps also comprising stages of different type, for example molecular drag stages.

In particular, it was disclosed that hybrid pumps comprising a regenerative stage according to the earlier European Application together with a type of molecular drag stage, for example are known as a "Holweck" stage, were particularly beneficial.

In a Holweck stage, there is provided alternate stationary and rotating concentric hollow cylinders with a threaded upstanding flange to form a helical structure substantially extending across the gap between adjacent cylinders, the flange being attached either to a surface of a rotating or of a stationary cylinder.

It was found that such pumps, especially the regenerative/molecular drag compound pumps, were generally able to provide a higher ultimate vacuum together with a relatively higher compression ratio than that available with comparable vacuum pumps.

Nevertheless, the pumps of our prior European application can in some circumstances suffer from the disadvantage that a sufficiently higher pumping capacity cannot always be attained.

This invention is concerned with a modified design of vacuum pump in which this and other disadvantages are removed.

SUMMARY OF THE INVENTION

In accordance with the invention, there is provided a vacuum pump for pumping gas from a pump inlet to a pump outlet, comprising a rotor and a stator body in which the rotor is adapted for rotation and including at least two molecular drag stages each comprising adjacent stationary and rotating Holweck cylinders attached to the stator body and the rotor respectively and with a threaded upstanding helical flange positioned therebetween which is attached either to the stationary or to the rotating cylinder wherein the molecular drag stage closest to the pump inlet has the threaded flange on its rotating cylinder and the subsequent molecular drag stage or stages has the threaded flange on the stationary cylinder A central feature of the invention is the presence of a threaded flange on the rotating Holweck cylinder of the first Holweck stage, ie the Holweck stage closest to the pump inlet. It is this feature—coupled with the reverse positioning of the flange in the subsequent Holweck stage—which allows the pump overall to exhibit generally superior properties with particular reference to the high pumping capacity and compression and low power consumption at higher (inlet) pressures.

In addition, it is extremely advantageous for the Holweck stages to be arranged in a radial configuration, in particular adapted so that the gas being pumped flows radially outwards from the first Holweck cylinder to a subsequent, radially arrayed Holweck cylinder or cylinders. The additional benefits of such pumps include:

i) a lower power consumption in continuum flow than with axially arranged Holweck cylinders of comparable outside diameter ii) an ability to assemble and dis-assemble the rotor from the pump body iii) compactness of the pump overall The pumps of the inventions preferably also include a regenerative stage towards the outlet end of the pump such that gas being pumped enters the regenerative stage following its exhaustion for the molecular drag stages. Preferably, the regenerative stage comprises a series of blades positioned in an annular array on one or both faces of the rotor or on an edge of the rotor.

In preferred embodiments, the rotor has at least two series of blades positioned in concentric annular arrays on a face of the rotor and the stator has a corresponding number of channels in which the arrays of blade can rotate.

In such embodiments, the blades advantageously extend in a substantially axial direction. The rotor is preferably shaped such that the side on which the arrays of blades are positioned presents a substantially flat surface for receiving the arrays; usually, the flat surface will be radially orientated relative to the main axis of the rotor. Generally, the flat surface between the arrays will cooperate with corresponding annular flat surfaces on the stator to provide a face seal between the arrays.

If appropriate, the invention also incorporates the possibility of there being at least two arrays of blades on each side of the rotor, each side preferably presenting a substantially flat surface for receiving the arrays.

In preferred embodiments, the rotor has at least five or six arrays on one or both sides thereof.

The individual blades of each array will generally be arranged radially in relation to the rotor. Each blade may be substantially flat or, at least in part, may be arcuate with the concave side pointing in the direction of travel of the rotor; the latter is preferred to assist in pumping efficiency.

It is preferred for the blade edges which co-operate with the stripper to have a flat surface rather than pointed or radiused ends to improve the "sealing" between the blades and the stripper.

Typically, each array may comprise at least about ten, preferably at least fifty blades. Generally, there may usefully be up to about one hundred and fifty blades in each array. Preferably the cross-sectional area of the main part of the channel is from three to six times that of the radial cross-section of the blade.

Having more than one series of blades in annular arrays on the surface of a rotor in accordance with the invention affords various advantages and opportunities. Firstly the arrangement of the blades and corresponding channels in a series of concentric arrays relative to the pump shaft can provide an inherent volumetric compression ratio if a flow of gas being evacuated is caused to occur from the outermost array to the innermost array to exhaust towards the centre of the pump. This effect is increased if the cross-sectional area of the individual channels is decreased gradually from the outermost to the innermost channel. For example, in a pump having six such arrays, the cross-sectional area of the innermost channel may be of the order of one-sixth to one-half of that of the outermost channel.

Secondly, the concentric arrays of blades/channels allows for a shorter pump overall in the axial direction than one with a multi-stage axial array of blades.

Thirdly, the axial load can be reduced, in particular if the flow of gas is arrayed from the outside to the inside channel, because of the highest pressure forces in such an arrangement are at the centre of the pump and act over a smaller area.

Fourthly, use of a particularly preferred feature in which each array of blades is mounted on a raised ring present on the surface of the rotor with the corresponding stator channels being present about the blades to allow rotation of the blades therethrough but with a relatively close tolerance between the stator and the curved surfaces of the raised ring provides the opportunity of radial sealing between the rotor and the stator.

In the molecular drag stage it has been found to be particularly useful to arrange the Holweck cylinders axially with the spinning cylinder(s) being mounted on the same shaft as the spinning rotor of the regenerative stage.

In conjunction with the regenerative pump stage of the invention in which the rotor blades will generally depend axially from the rotor, a corresponding axial arrangement of the Holweck cylinders is preferred. In combination with the regenerative blades on the rotor, this forms a pump that has no radially interleaving stator sections, thereby allowing ready assembly and dis-assembly of the pump.

In such respects, it is preferred for one pump stage to be on one side of the rotor and the other stage to be on the opposite side of the rotor. This feature affords the possibility of a smaller, lighter pump overall.

The Holweck stage will in particular generally be at the inlet (high vacuum or low pressure) end of the pump and such an axial arrangement of the Holweck cylinders has been found to provide a natural inlet for the pump as a whole by causing gas to enter through the innermost cylinder. It can advantageously be arranged for gas flow in the Holweck stages to be from the centre outwards and in the regenerative stages to be from the outer periphery inwards, thereby leading to a balanced, efficient pump overall.

In combined regenerative/Holweck pumps, the general design lends itself advantageously to a single piece rotor which can usefully be made of a light metal or alloy, for example aluminium.

In preferred embodiments, the rotating Holweck cylinder of the first molecular drag stage has a threaded flange of greater radial flange depth overall in comparison with that of the subsequent Holweck stage or stages. This allows for a greater pumping capacity generally. Furthermore the threaded flange of the first Holweck stage advantageously may possess a variable thread pitch and/or thread channel depth. The presence of one, preferably both, of these generally allows for low power consumption in operating the pump, particularly at high (inlet) pressure operation, coupled with suitable performance at low (inlet) pressures. It is the combination of having a rotatable Holweck flange and the deep thread or channel depth which allows for lower power consumption in operating the pump, especially at high inlet pressures, coupled with good performance at low inlet pressures.

In these preferred embodiments, the pitch is advantageously varied such that the pitch gradually decreases in a direction away from the pump inlet and the thread depth is also advantageously varied such that the depth gradually decreases in a direction away from the pump inlet such that they offer a high pumping capacity at the inlet to the stage.

Pumps of the invention having in particular the Holweck cylinders arranged in a radial direction, with gas being pumped during operation of the pump being urged from a centrally positioned inlet in a generally radially outward direction through the Holweck stages and with the regenerative stages being positioned axially beneath the Holweck stages, for example with the blades arranged on a face of the rotor in a direction pointing generally away from the Holweck stages such that, in particular the regenerative stages are similarly radially arranged, have the advantage that pumps of the invention may be of overall compact design and, in addition, be made available in different constructional modules.

For example, a standard platform module may include a simple rotor disc on a lower face of which depend the blades of the regenerative stage and on an upper face of which is a single axially depending Holweck stage comprising a stationary, flanged Holweck cylinder and a rotating, non-flanged Holweck cylinder.

A second module may additionally comprise an additional Holweck stage with a further rotatable, non-flanged cylinder; subsequent module may additionally comprise further rotatable non-flanged Holweck cylinders.

A final module may comprise the complete pump according to the invention including a further Holweck stage comprising a rotatable, flanged cylinder, preferably with a variable pitch and/or flange depth, nearest the pump inlet.

BRIEF DESCRIPTION OF THE DRAWINGS

For a better understanding of the invention, reference will now be made, by way of exemplification only, to the accompanying drawings, in which.

DETAILED DESCRIPTION OF THE INVENTION

Figure 1:
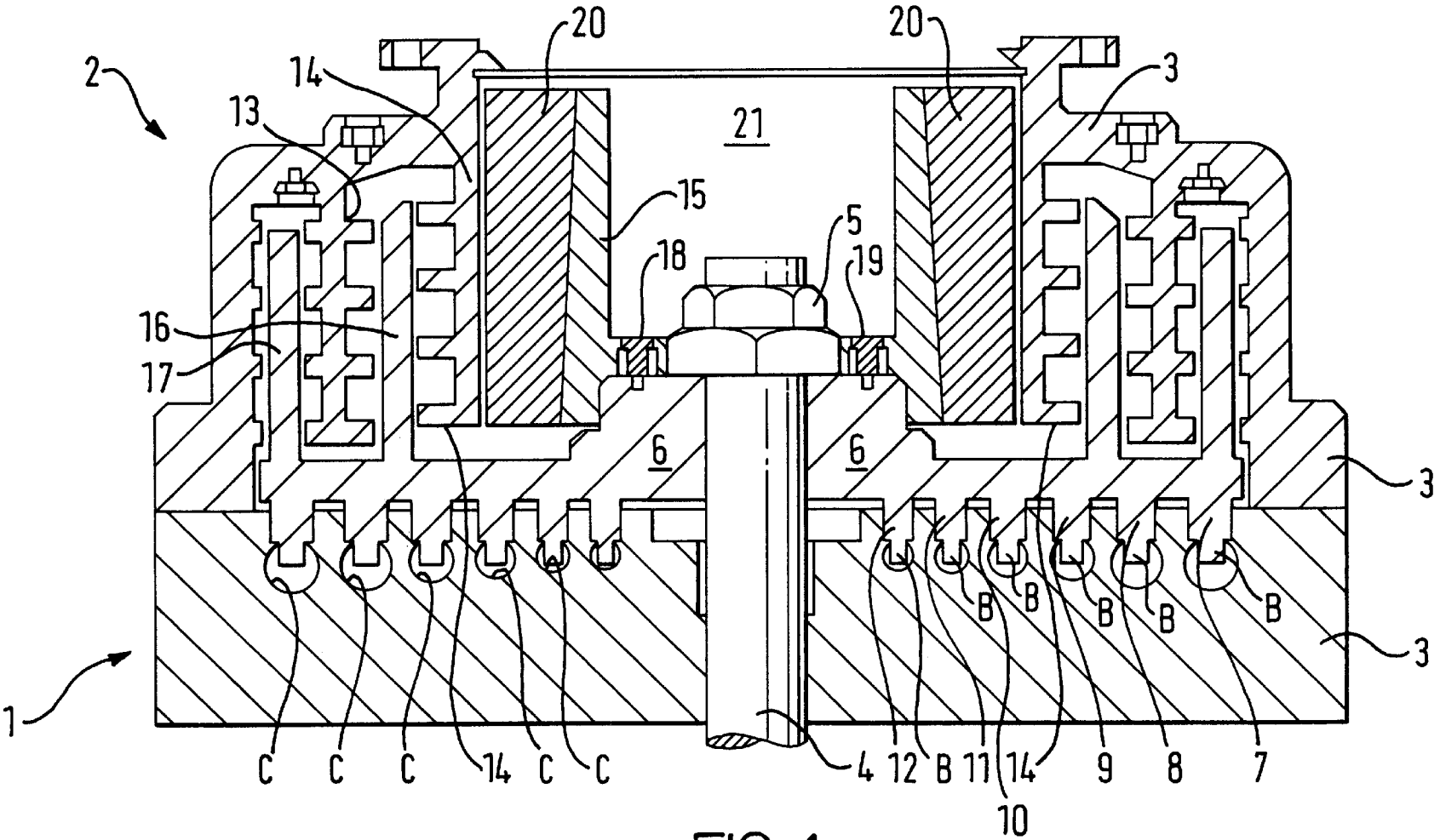
FIG. 1 is a schematic sectional view through a vacuum pump of the invention showing both regenerative and Holweck stages.

With reference to the drawings and initially to FIG. 1 in particular, there is shown a vacuum pump of the invention having a regenerative stage generally indicated by reference numeral 1 and a molecular drag (Holweck) stage generally indicated by the reference numeral 2.

The vacuum pump comprises a stator body 3 made of a number of different portions bolted (or otherwise fixed) together and provided with relevant seals therebetween.

Mounted in the body 3 is a shaft 4 which is adapted for rotation about its longitudinal axis and is driven by an electrical motor (not shown) surrounding the shaft 4 in a manner known per se.

With regard to the regenerative stage 1, securely attached to the shaft 4 by bolt means 5 is a rotor 6. The rotor 6 is generally in the form of a circular disc, the lower (as shown) surface of which presents a substantially flat surface on which are positioned integrally therewith a plurality (six) of raised rings 7, 8, 9, 10, 11, 12 situated symmetrically on the rotor about its centre point. Mounted on each of the raised rings is a series of equally spaced arrays of blades B, for example, one hundred blades in each array to form concentric annular arrays of blades.

The width of each ring, and the corresponding size of the blades on each ring, gradually decreases from the outermost ring 7 to the innermost ring 12. Each of the blades is slightly arcuate with the concave side pointing in the direction of travel of the rotor.

The body 3 contains six circular channels C in its upper (as shown) surface which are of "keyhole" cross section and are of a size which closely accommodates in the rectangular section upper (as shown) parts the six raised rings 7, 8, 9, 10, 11, 12; the circular section lower (as shown) parts accommodate the corresponding blades of the relevant raised ring, the blade cross section being about one sixth of the cross sectional area of the circular section part of the channels.

As with all pumps of the regenerative mode of operation of this general type, each channel C (in this case the circular cross-section part thereof) has a reduced cross sectional area (not shown) for a small, for example 1 cm, part of its arcuate length of a shaped size substantially the same as that of the corresponding blades accommodated therein. This reduced cross sectional part of each channel forms the "stripper" which, in use, urges gas passing through that channel to be deflected by porting (not shown) in to the next (inner) channel.

The arrangement described above including the mounting of the blades on the raised rings represents an improvement in that it allows for radial sealing between the rotor and stator as well as axial sealing previously employed. In this respect, the radial sealing occurs between the sides of the raised rings 7, 8, 9, 10, 11, 12 and the corresponding sides of the rectangular cross sectional part of the relevant channel, especially the outermost sides as shown.

With regard to the Holweck stage 2, this stage is generally formed within an upper portion of the body 3.

Depending from the upper body portion 3 and forming the stator for this stage are a set of two hollow annular cylinders 13 and 14 orientated axially with regard to the shaft 4.

A set of three further concentric hollow cylinders 15, 16 and 17, also orientated a axially with regard to the shaft 4, are securely fixed at their lower (as shown) ends to be upper surface of the rotor 6 and therefore adapted to rotate therewith. Two of these three cylinders 16 and 17 are integrally formed with the rotor 6. The remaining cylinder 15 is fixed to the rotor 6 by means of bolts 18, 19.

Each of the five Holweck cylinders is mounted symmetrically about the main axis of the pump and the cylinders of one set are inter-leaved with those of the other set in the manner shown in FIG. 1, thereby forming a uniform gap between each if adjacent cylinder.

Figure 2:
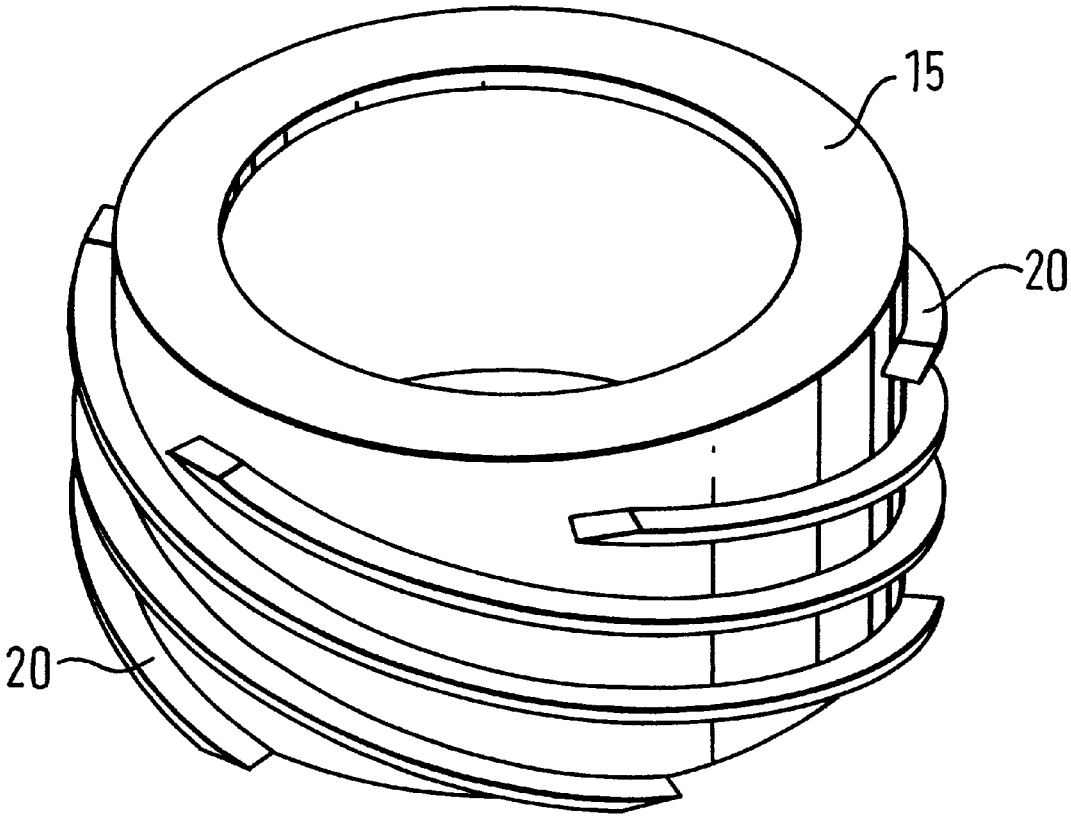
FIG. 2 is a schematic perspective view (not to scale) of the inner Holweck flanged cylinder of the pump of FIG. 1.

Situated in the gap between each adjacent cylinder is a threaded upstanding flange (or flanges) to form a helical structure substantially extending across the gap. These flanges are attached to the inner face of one of the body portions 3, to the stationary cylinders 13 and 14 (on both faces of the cylinder 13) and to the outer face of the rotatable cylinder 15 as shown more clearly in FIG. 2. Some or all of these flange sections may be of variable pitch and/or flange depth to enhance pumping performance. It will be noted that the flange of each cylinder may be a continuous one or may comprise a number of flanges which collectively form the helical arrangement overall, for example as shown in FIG. 2.

With regard to the rotatable cylinder 15, the upstanding threaded flange 20 attached thereto is of variable pitch and flange depth and of overall greater flange depth than the flanges of the other Holweck stages. The pitch and flange depths are preferably varied axially in a progressive manner and are selected to offer optimum pumping performance at the pump inlet.

A key feature of the pumps of the invention is that the upstanding flange 20 for the initial Holweck stage is situated on the rotatable cylinder 15 whereas the thread for the subsequent stages is situated on the relevant stationary Holweck cylinder. The rotation of the Holweck cylinder 15 with its attached thread affords a high inlet pumping capacity at the expense of a small amount of extra power at high pressures, while the presence of subsequent Holweck threads on the cylinders 13, 14 offers high compression and lower power consumption. Thus the overall pump design offers a good compromise of low power and high pumping performance.

In use of the pump with the shaft 4 and rotor 6 spinning at high speed, gas is drawn in to an inlet 21 within the body portion 3 and in to the gap between adjacent Holweck cylinders 14 and 15. It then passes down the helix formed by the upstanding flange 20 on the cylinder 15 and thence up the gap between the cylinders 14 and 16 and so on until it passes down the gap between the cylinder 17 and the thread on the inner face of the body portion 3. It then passes through porting not shown in to the circular section part of the channel associated with the ring 7, thence through the channels associated with the rings 8, 9, 10, 11, 12 (in that order) by means of the action of the respective strippers until being exhausted from the pump via outlet bores in the body portion 3 (not shown).

The gas flow is therefore generally radially outwards in the molecular drag (Holweck) stage and radially inwards in the regenerative stage, thereby leading to a balanced, efficient pump. This can generally obviate the need to provide a plurality of dynamic seals between high pressure regions and low pressure regions of the pump.

The arrangement described with reference to the drawings can also be readily assembled/dis-assembled by virtue of an ability to remove the rotor axially for maintenance simply by removal from the body portion 3, including dis-assembly of the upper threaded portions of the body 3.

Pumps of the invention afford the advantage that they may be made available in different constructional modules. In this respect, FIGS. 2, 3 and 4 show examples of such modules.

Figure 3:
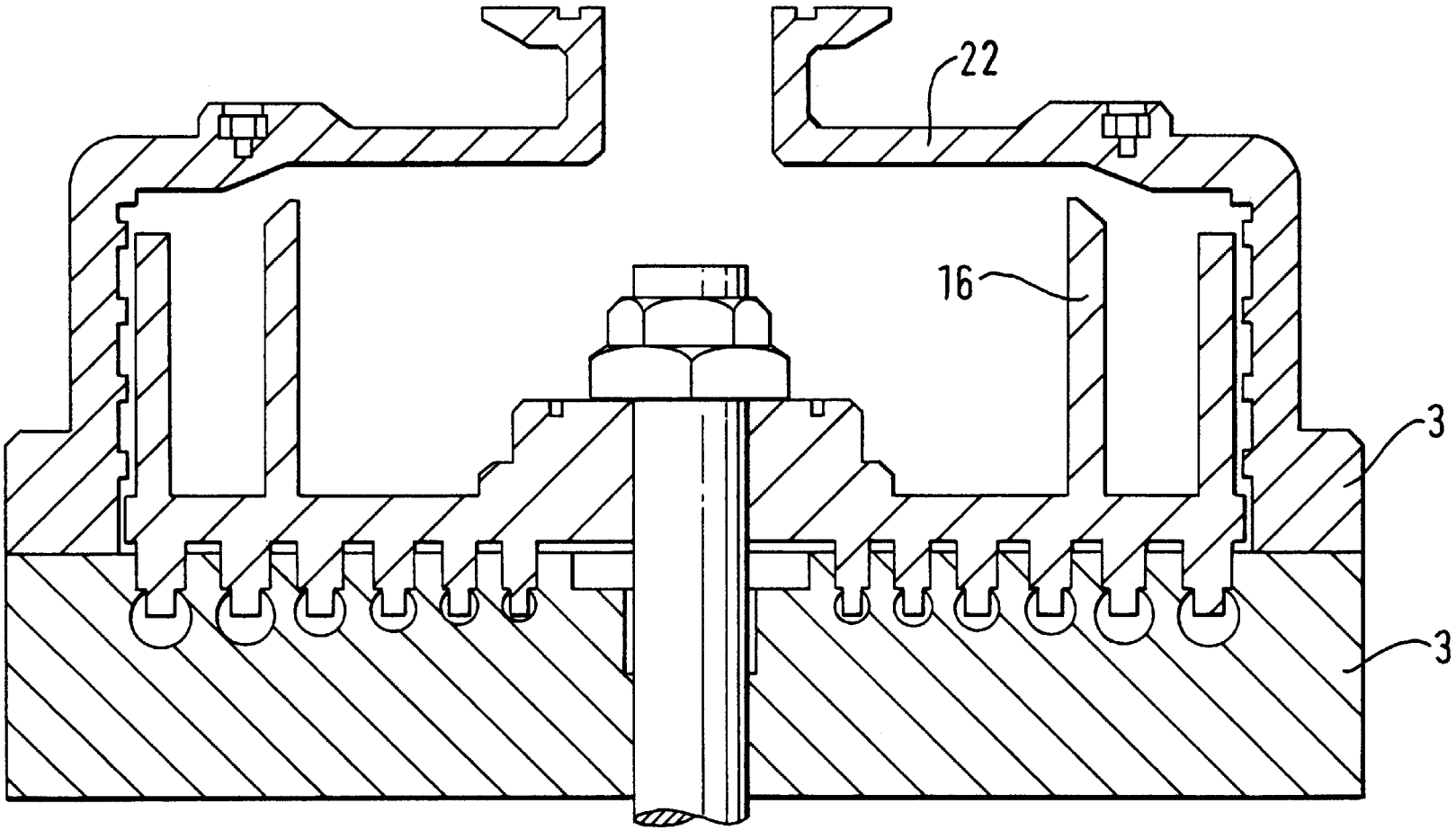
FIG. 3 is a platform module for the vacuum pump shown in FIG. 1.

FIG. 3 in particular shows the simplest module showing only one Holweck stage formed by the body portion 3 and the rotatable cylinder 17 and with a smaller pump inlet formed by the additional body portion 22. It will be appreciated that the cylinder 16 serves no useful purpose in operation of the pump.

Figure 4:
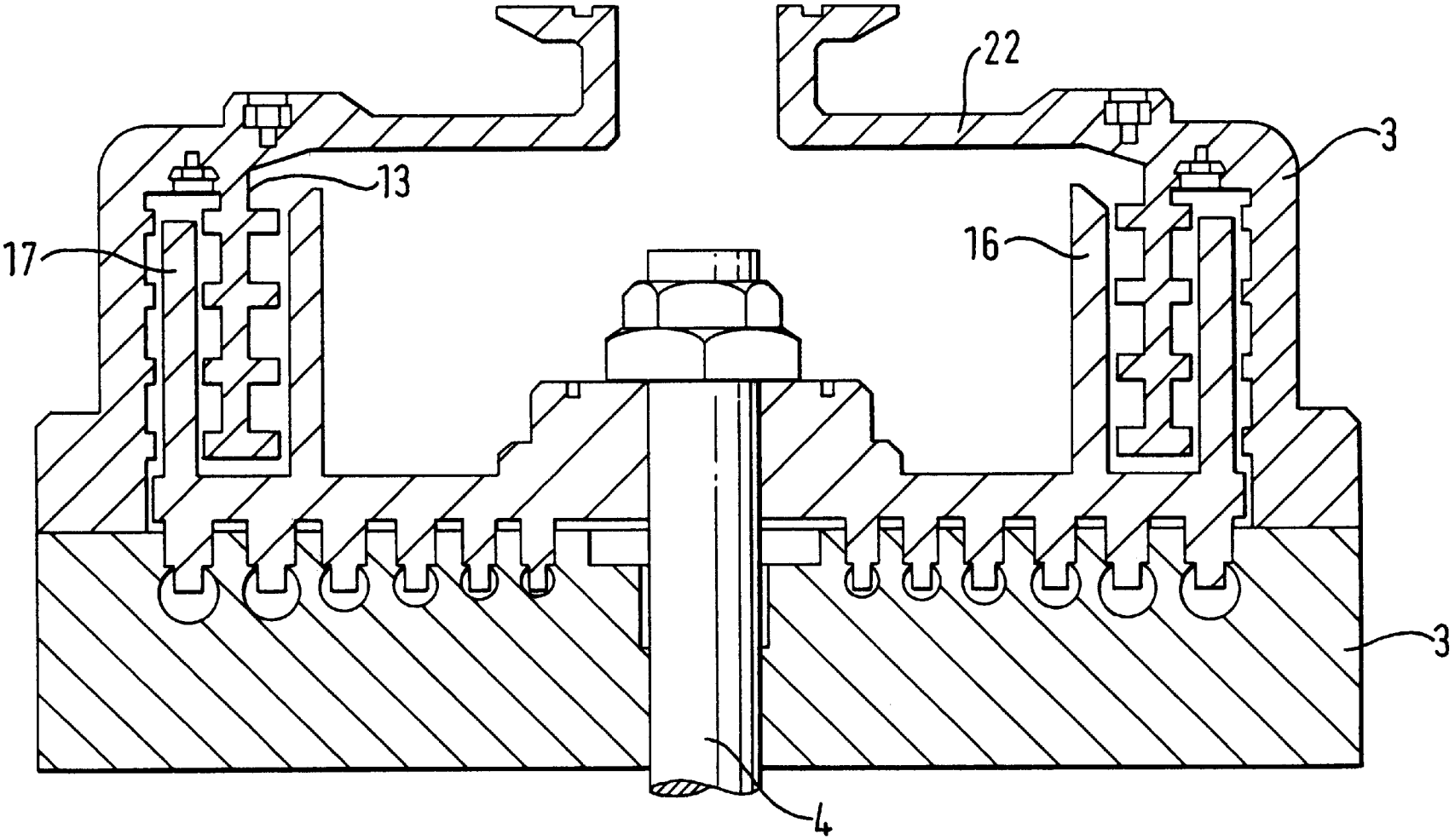
FIG. 4 is a second module for the vacuum pump shown in FIG. 1.

FIG. 4 provides three Holweck stages formed between the body portion 3, the stationary Holweck cylinder 13 (including its flanges on two faces) and the rotating cylinders 16 and 17.

Figure 5:
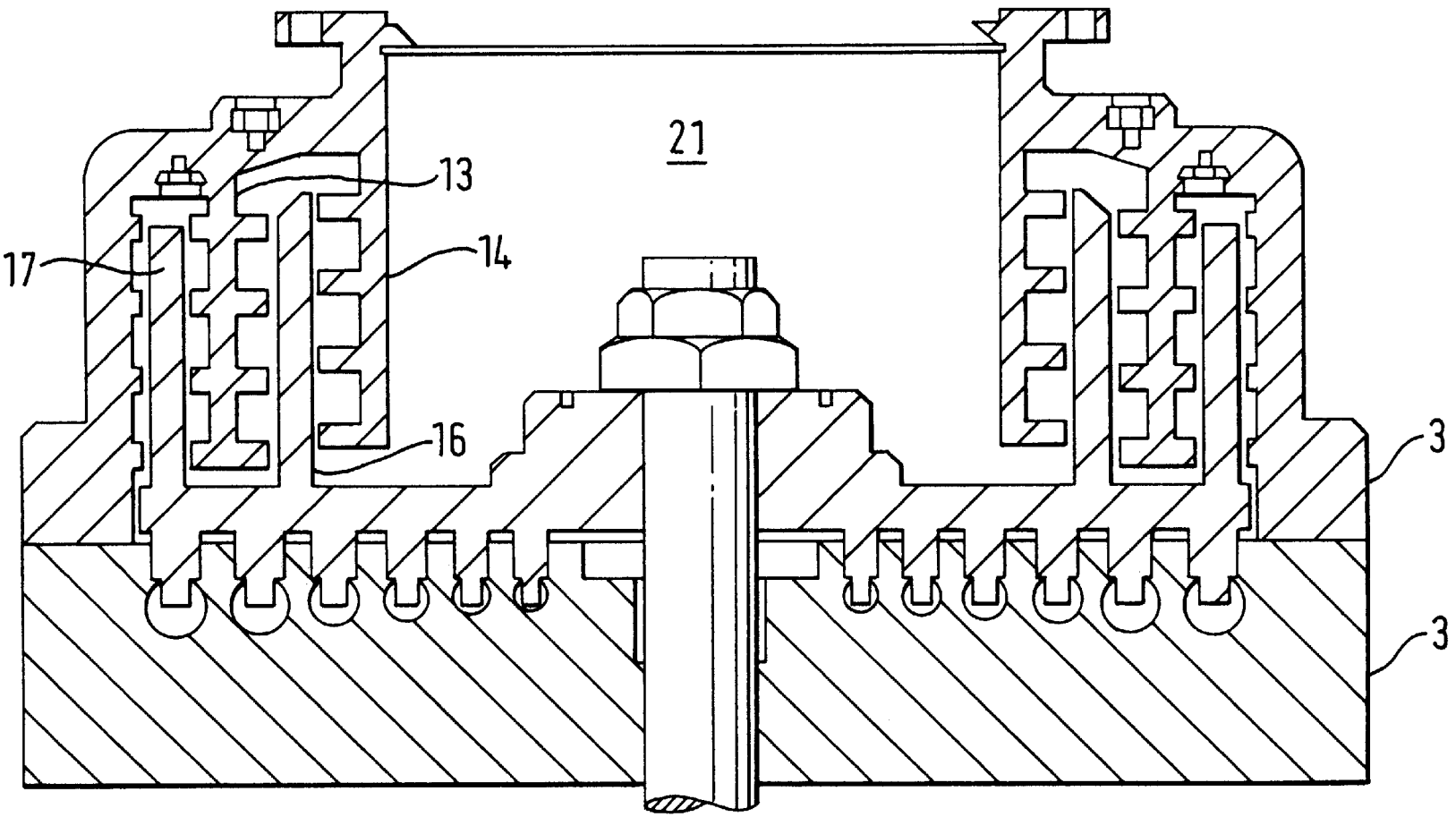
FIG. 5 is a further module for the vacuum pump shown in FIG. 1.

FIG. 5 provides four Holweck stages formed between the body portion 3, the stationary Holweck cylinders 13 and 14 and the rotating cylinders 16 and 17. This module also has the broader aperture 21 of FIG. 1, ie broader than that of FIGS. 3 and 4 to provide adequate pumping capacity and which can be combined with the Holweck cylinder 14.

I claim:

1. A vacuum pump for pumping gas from a pump inlet to a pump outlet, comprising a rotor and a stator body in which the rotor is adapted for rotation and including at least two molecular drag stages each comprising adjacent stationary and rotating Holweck cylinders attached to the stator body and the rotor respectively and with a threaded upstanding helical flange positioned therebetween which is attached either to the stationary or to the rotating cylinder wherein the molecular drag stage closest to the pump inlet has the threaded flange on its rotating cylinder and the subsequent molecular drag stage or stages has the threaded flange on the stationary cylinder.

2. The vacuum pump according to claim 1 in which the Holweck stages are arranged in a radial configuration and adapted so that gas being pumped flows outwards from the first Holweck cylinder to a subsequent cylinder stage(s).

3. The vacuum pump according to claim 1 also including a regenerative stage towards the outlet end of the pump such that gas being pumped enters the regenerative stage following its exhaustion for the molecular drag stages.

4. The vacuum pump according to claim 3 in which the regenerative stage comprises a series of blades positioned in an annular array on one or both faces of the rotor or on an edge of the rotor.

5. The vacuum pump according to claim 4 in which the rotor has at least two series of blades positioned in concentric annular arrays on a face of the rotor and the stator has a corresponding number of channels in which the arrays of blade can rotate.

6. The vacuum pump according to claim 5 in which the blades extend in a substantially axial direction.

7. The vacuum pump according to claim 3 in which the rotor has at least five or six arrays on one or both sides thereof.

8. The vacuum pump according to claim 5 in which a flow of gas being evacuated is caused to occur from the outermost array to the innermost array to exhaust towards the centre of the pump and the cross-sectional area of the individual channels is decreased gradually from the outermost to the innermost channel.

9. The vacuum pump according claim 2 in which the rotating Holweck cylinder of the first molecular drag stage has a threaded flange of greater radial flange depth overall in comparison with that of the subsequent Holweck stage or stages.

10. The vacuum pump according to claim 2 in which the threaded flange of the first Holweck stage possesses a variable thread pitch and/or thread channel depth.

11. The vacuum pump according to claim 1 which is made available in different constructional modules.

* * * * *